US010386064B2

(12) United States Patent
Mawatari et al.

(10) Patent No.: US 10,386,064 B2
(45) Date of Patent: Aug. 20, 2019

(54) STOKER-TYPE INCINERATOR

(71) Applicant: MITSUBISHI HEAVY INDUSTRIES ENVIRONMENTAL & CHEMICAL ENGINEERING CO., LTD., Yokohama-shi, Kanagawa (JP)

(72) Inventors: Masayuki Mawatari, Tokyo (JP); Yoshimasa Sawamoto, Yokohama (JP); Kouji Namerisawa, Yokohama (JP)

(73) Assignee: MITSUBISHI HEAVY INDUSTRIES ENVIRONMENTAL & CHEMICAL ENGINEERING CO., LTD., Kanagawa (JP)

( * ) Notice: Subject to any disclaimer, the term of this patent is extended or adjusted under 35 U.S.C. 154(b) by 216 days.

(21) Appl. No.: 15/509,967

(22) PCT Filed: Sep. 9, 2015

(86) PCT No.: PCT/JP2015/075586
§ 371 (c)(1),
(2) Date: Mar. 9, 2017

(87) PCT Pub. No.: WO2016/039374
PCT Pub. Date: Mar. 17, 2016

(65) Prior Publication Data

US 2017/0261206 A1 Sep. 14, 2017

(30) Foreign Application Priority Data

Sep. 12, 2014 (JP) ..... 2014-186387

(51) Int. Cl.
*F23G 5/04* (2006.01)
*F23J 7/00* (2006.01)
(Continued)

(52) U.S. Cl.
CPC ..... *F23G 5/04* (2013.01); *F23G 5/00* (2013.01); *F23G 5/14* (2013.01); *F23G 5/165* (2013.01);
(Continued)

(58) Field of Classification Search
CPC ..... F23G 5/04
See application file for complete search history.

(56) References Cited

U.S. PATENT DOCUMENTS 6,336,415 B1 1/2002 Ruegg et al.
2004/0182292 A1* 9/2004 Shimrony ..... F23G 5/14 110/237
(Continued)

FOREIGN PATENT DOCUMENTS

CN 1300359 A 6/2001
EP 1077077 A2 2/2001
(Continued)

OTHER PUBLICATIONS

International Search Report in International Patent Application No. PCT/JP2015/075586, dated Dec. 15, 2015.
(Continued)

*Primary Examiner* — Nathaniel Herzfeld
(74) *Attorney, Agent, or Firm* — Kanesaka Berner and Partners, LLP

(57) ABSTRACT

A stoker-type incinerator includes: a recirculated exhaust gas supply unit which allows exhaust gas resulting from treating combustion gas to reflux to a combustion gas channel via a recirculated exhaust gas nozzle provided on the combustion gas channel and supplies the exhaust gas as recirculated exhaust gas. The stoker-type incinerator further includes a secondary combustion air supply unit which supplies secondary combustion air on a downstream side of the recirculated exhaust gas nozzle on the combustion gas
(Continued)

channel via a secondary combustion air nozzle provided on the combustion gas channel, in which the recirculated exhaust gas nozzle and the secondary combustion air nozzle are arranged in different positions in a plan view.

13 Claims, 7 Drawing Sheets

(51) Int. Cl.

| | |
|---|---|
| ***F23G 5/00*** | (2006.01) |
| ***F23G 5/44*** | (2006.01) |
| ***F23G 5/14*** | (2006.01) |
| ***F23J 15/00*** | (2006.01) |
| ***F23G 5/16*** | (2006.01) |

(52) U.S. Cl.

CPC ..... *F23G 5/44* (2013.01); *F23G 5/442* (2013.01); *F23J 7/00* (2013.01); *F23J 15/003* (2013.01); *F23G 2201/10* (2013.01); *F23G 2900/00001* (2013.01)

(56) References Cited

U.S. PATENT DOCUMENTS

| | | | |
|---|---|---|---|
| 2010/0101463 | A1 | 4/2010 | Saviharju et al. |
| 2014/0182492 | A1 | 7/2014 | Waldner |

FOREIGN PATENT DOCUMENTS

| | | | | |
|---|---|---|---|---|
| JP | H2-47648 | B2 | | 10/1990 |
| JP | 9-126412 | A | | 5/1997 |
| JP | 2000-93741 | A | | 4/2000 |
| JP | 2001-90920 | A | | 4/2001 |
| JP | 2004-239509 | A | | 8/2004 |
| JP | 2005106370 | A | * | 4/2005 |
| JP | 2005-140645 | A | | 6/2005 |
| JP | 2005-201548 | A | | 7/2005 |
| JP | 2005-299939 | A | | 10/2005 |
| JP | 4236593 | B2 | | 3/2009 |
| JP | 2009-103381 | A | | 5/2009 |
| JP | 2009103381 | A | * | 5/2009 |
| JP | 2010-230280 | A | | 10/2010 |
| JP | 2012-93013 | A | | 5/2012 |
| JP | 2014-74515 | A | | 4/2014 |
| JP | 2014-102020 | A | | 6/2014 |
| JP | 2014-513786 | A | | 6/2014 |
| TW | 448273 | B | | 8/2001 |
| TW | 485228 | B | | 5/2002 |
| WO | 2004/92648 | A1 | | 10/2004 |

OTHER PUBLICATIONS

Written Opinion in International Patent Application No. PCT/JP2015/075586, dated Dec. 15, 2015.

* cited by examiner

STOKER-TYPE INCINERATOR

RELATED APPLICATIONS

The present application is a National Phase of PCT/JP2015/075586, filed Sep. 9, 2015, and claims priority based on Japanese Patent Application No. 2014-186387, filed Sep. 12, 2014.

TECHNICAL FIELD

The present invention relates to a stoker-type incinerator including a stoker which burns an object to be incinerated, such as municipal waste, while being conveyed.

BACKGROUND ART

A stoker-type incinerator is an incinerator including a stoker formed by fire grates at a fixed stage and a movable stage being alternately arranged. In the stoker-type incinerator, while waste (object to be burned) put in by a hopper is stirred and moved forward, waste in a drying zone disposed on the upstream side of the stoker is dried by reciprocating the movable stage using a hydraulic device. The stoker-type incinerator is configured such that main combustion is performed while primary combustion air is put in a next main combustion zone of the drying zone and ember combustion is performed on combusted residues in an ember combustion zone on the most downstream side.

In such a stoker-type incinerator, a technique of allowing recirculated exhaust gas in which part of combustion gas (exhaust gas) in a combustion gas channel on the upper side of a stoker is extracted to reflux to a secondary combustion chamber in the combustion gas channel through a recirculation passage and providing the recirculated exhaust gas together with secondary combustion air for combustion is provided (for example, see PTL 1).

In other words, in this stoker-type incinerator, a furnace exhaust gas recirculation system is employed as one of means for achieving stabilized combustion with a low air ratio (reduction in exhaust gas flow rate of a furnace outlet). The furnace exhaust gas recirculation system is a system which draws combustion exhaust gas in a combustion region, boosts the combustion exhaust gas using a fan or the like, and then puts the combustion exhaust gas into a region of a secondary combustion unit again, because combustion exhaust gas generated from an ember combustion zone does not almost consume oxygen and has a composition close to the composition of air. Further, the furnace exhaust gas recirculation system is a system of improving boiler efficiency and achieving miniaturization of an exhaust gas treatment system by means of realizing stabilized combustion with a low air ratio and reducing the exhaust gas flow rate of the furnace outlet.

CITATION LIST

Patent Literature

[PTL 1] Japanese Unexamined Patent Application, First Publication No. 2009-103381

SUMMARY OF INVENTION

Technical Problem

In the technique of providing the recirculated exhaust gas together with secondary combustion air for combustion, for example, the recirculated exhaust gas and the secondary combustion air occasionally do not reach combustion gas resulting from an increase in size of an incinerator. Therefore, there has been a problem in that an effect of stirring combustion gas cannot be sufficiently obtained and a decrease in harmful gas such as a nitrogen oxide (NOx) or carbon monoxide (CO) becomes insufficient.

An object of the present invention is to provide a stoker-type incinerator which allows recirculated exhaust gas and secondary combustion air to reliably reach combustion gas circulating on the upper side in a furnace and is capable of stirring the combustion gas.

Solution to Problem

According to an aspect of the present invention, there is provided a stoker-type incinerator including: a stoker which burns an object to be incinerated while being conveyed; a combustion gas channel which guides combustion gas generated due to combustion of the object to be incinerated upward; a primary combustion air supply unit which supplies primary combustion air to the stoker; a recirculated exhaust gas supply unit which allows exhaust gas resulting from treating the combustion gas that has circulated through the combustion gas channel to reflux to the combustion gas channel via a recirculated exhaust gas nozzle provided on the combustion gas channel and supplies the exhaust gas as recirculated exhaust gas; and a secondary combustion air supply unit which supplies secondary combustion air on a downstream side of the recirculated exhaust gas nozzle on the combustion gas channel via a secondary combustion air nozzle provided on the combustion gas channel, in which the recirculated exhaust gas nozzle and the secondary combustion air nozzle are arranged in different positions in a plan view.

According to such a configuration, it is possible to allow the recirculated exhaust gas and the secondary combustion air to reliably reach the combustion gas circulating on the upper side in the furnace and to stir the combustion gas. As the result, it is possible to realize combustion with a low air ratio, greatly reduce the total amount of exhaust gas discharged from a smoke stack, and reduce the amount of steam used during an incineration process.

In the stoker-type incinerator, the recirculated exhaust gas nozzle may supply the recirculated exhaust gas along a conveyance direction of the object to be incinerated and the secondary combustion air nozzle may supply the secondary combustion air along the conveyance direction of the object to be incinerated.

In the stoker-type incinerator, a plurality of the recirculated exhaust gas nozzles and the secondary combustion air nozzles may be alternately arranged in a plan view.

In the stoker-type incinerator, the recirculated exhaust gas nozzles may be arranged at a height of 1000 mm to 2000 mm from a surface of a fuel layer formed by the object to be incinerated which is supplied to the stoker.

According to such a configuration, it is possible to blow the recirculated exhaust gas to flame of the object to be incinerated without excluding combustion of the object to be incinerated by the recirculated exhaust gas.

The stoker-type incinerator may further include a reducing agent supply unit which adds a reducing agent to part of the recirculated exhaust gas and blows the gas to the downstream of the secondary combustion air nozzles.

According to such a configuration, it is possible to suppress oxidation of the reducing agent before a denitration reaction compared to air by means of using the recirculated exhaust gas as gas that stirs the reducing agent of a non-catalytic denitration system.

In the stoker-type incinerator, the reducing agent may be blown to the downstream of the secondary combustion air nozzles in a furnace temperature range of 950° C. to 1050° C.

Advantageous Effects of Invention

According to the present invention, it is possible to allow recirculated exhaust gas and secondary combustion air to reliably reach combustion gas circulating on the upper side in a furnace and is capable of stirring the combustion gas.

DESCRIPTION OF EMBODIMENTS

First Embodiment

Hereinafter, an incinerator facility including a stoker-type incinerator according to a first embodiment of the present invention will be described. Further, the present invention relates to the incinerator facility used to perform an incinerator treatment on an object to be incinerated such as municipal waste.

Figure 1:
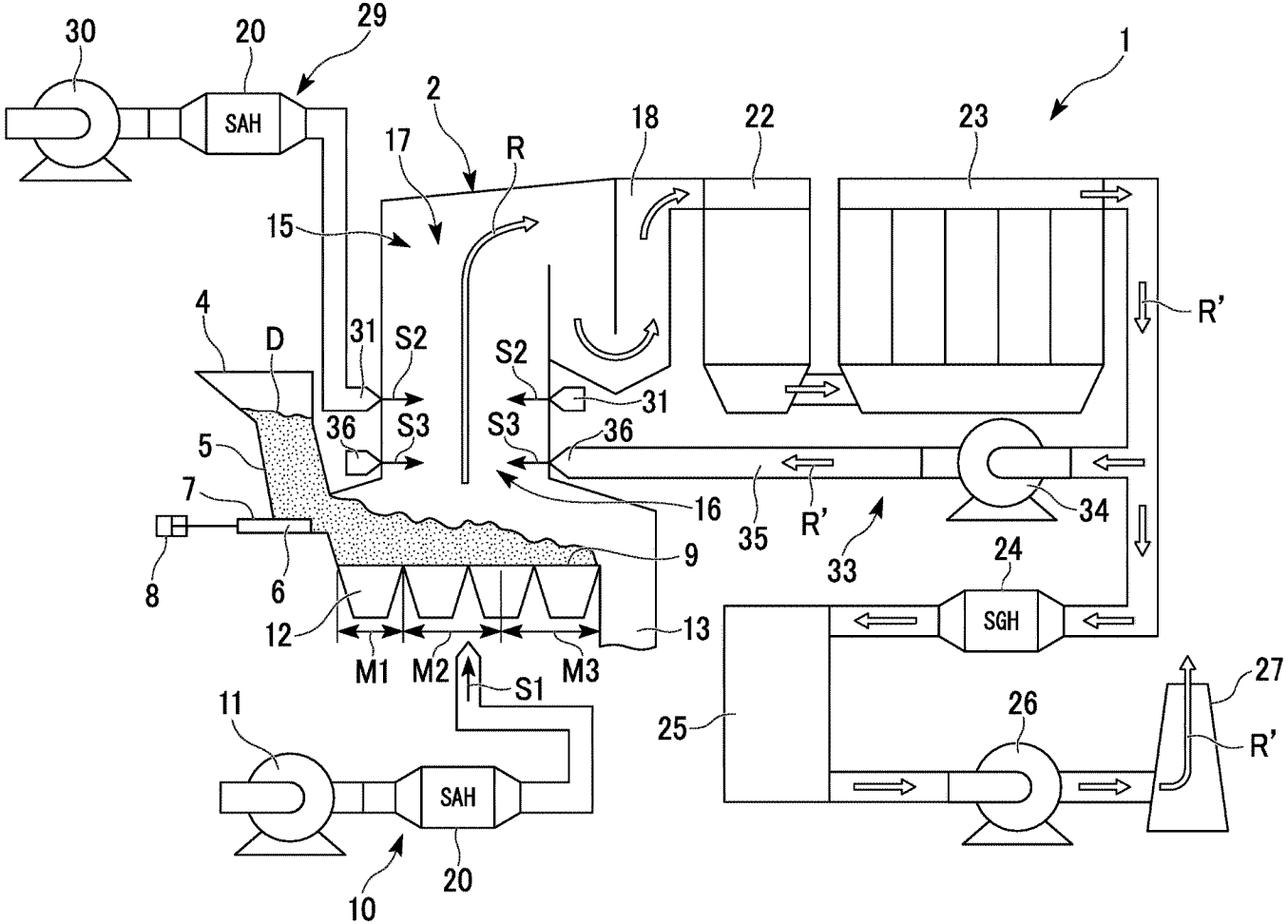
FIG. 1 is a configuration view schematically illustrating an incineration facility of a first embodiment of the present invention.

As illustrated in FIG. 1, an incinerator facility 1 of the present embodiment includes: a hopper 4 (hopper chute) temporarily storing an object D to be incinerated; a stoker-type incinerator 2 burning the object D to be incinerated; a feeder 7 moving, back and forth, the object D to be incinerated which is continuously supplied onto a feeder table 6 from the hopper 4 through a chute portion 5 with a predetermined stroke so that the object D is extruded and put into the incinerator; and a feeder drive unit 8 used to move the feeder 7 back and forth on the feeder table 6.

The stoker-type incinerator 2 includes, on a bottom portion side, a stoker 9 formed by alternately arranging metallic fixed fire grates and movable fire grates reciprocating in a flow direction of waste.

The incinerator facility 1 includes a primary combustion air supply unit 10 which supplies primary combustion air S1 to respective units of the stoker 9 from a pressure blower 11 through an air box 12. The primary combustion air supply unit 10 includes a steam air heater 20 (SAH) which preheats the primary combustion air S1.

The stoker 9 includes: a drying stoker portion M1 which receives the object D to be incinerated, which is extruded by the feeder 7 and fallen into the incinerator, and allows the moisture of the object D to be incinerated to be evaporated and is used for partial thermal decomposition; a combustion stoker portion M2 which allows the primary combustion air S1 supplied from the air box 12 on the lower side to ignite the object D to be incinerated, which is dried by the drying stoker portion M1, and burns the volatile content and the fixed carbon content; and a post-combustion stoker portion M3 which burns the unburned content such as the fixed carbon content passed through from the combustion stoker portion M2 without being burned until the unburned content is turned into ashes. Further, an ash discharge port 13 is provided on an outlet of the post-combustion stoker portion M3 so that ashes are discharged from the incinerator through the ash discharge port 13.

The inside of the stoker-type incinerator 2 is a combustion gas channel 15 in which combustion gas R generated due to combustion of the object D to be incinerated is guided upward. The combustion gas channel 15 includes a primary combustion chamber 16 on the upper side of the stoker 9 and a secondary combustion chamber 17 on the upper side of the primary combustion chamber 16, and the combustion gas R is circulated from the stoker 9 to the primary combustion chamber 16 and from the primary combustion chamber 16 to the secondary combustion chamber 17, that is, from the lower side to the upper side. In the stoker-type incinerator 2, a heat recovery boiler 18 is disposed so as to be connected to the downstream side of the secondary combustion chamber 17 in the circulation direction of the combustion gas R.

The stoker-type incinerator 2 includes a secondary combustion air supply unit 29 which supplies secondary combustion air S2 to the combustion gas channel 15 from a secondary pressure blower 30. The secondary combustion air S2 is supplied to the combustion gas channel 15 via a secondary combustion air nozzle 31 attached to the furnace wall of the stoker-type incinerator 2. Similar to the primary combustion air supply unit 10, a steam air heater 20 preheating the secondary combustion air S2 is provided in the secondary combustion air supply unit 29.

Further, exchange gas R' thermally recovered by the heat recovery boiler 18 is treated by passing through a temperature reduction tower 22 and a reaction dust collector 23 (bag filter). The exhaust gas R' treated by passing through the temperature reduction tower 22 and the reaction dust collector 23 is discharged to the outside from a smoke stack 27 through a steam gas heater 24 (SGH), a catalytic reaction tower 25, and an induced blower 26.

Further, the incineration facility 1 of the present embodiment includes an exhaust gas recirculation 33 (EGR) which supplies the exhaust gas R' treated by the reaction dust collector 23 to the combustion gas channel 15 between a nozzle for primary combustion air S1 and the secondary combustion air nozzle 31 as recirculated exhaust gas S3.

The recirculated exhaust gas supply unit 33 allows the exhaust gas R' to reflux using a recirculated exhaust gas blower 34 and then supplies the exhaust gas R' to the combustion gas channel 15. After the exhaust gas R' passes through a recirculation passage 35, the exhaust gas R' is supplied to the combustion gas channel 15 via an EGR nozzle 36 (recirculated exhaust gas nozzle) provided on the furnace wall.

The EGR nozzle 36 is provided on the upstream side of the secondary combustion air nozzle 31 in the circulation direction of combustion gas R. In other words, the secondary combustion air supply unit 29 is provided on the downstream side of the recirculated exhaust gas supply unit 33 in the circulation direction of the combustion gas channel 15.

Figure 2:
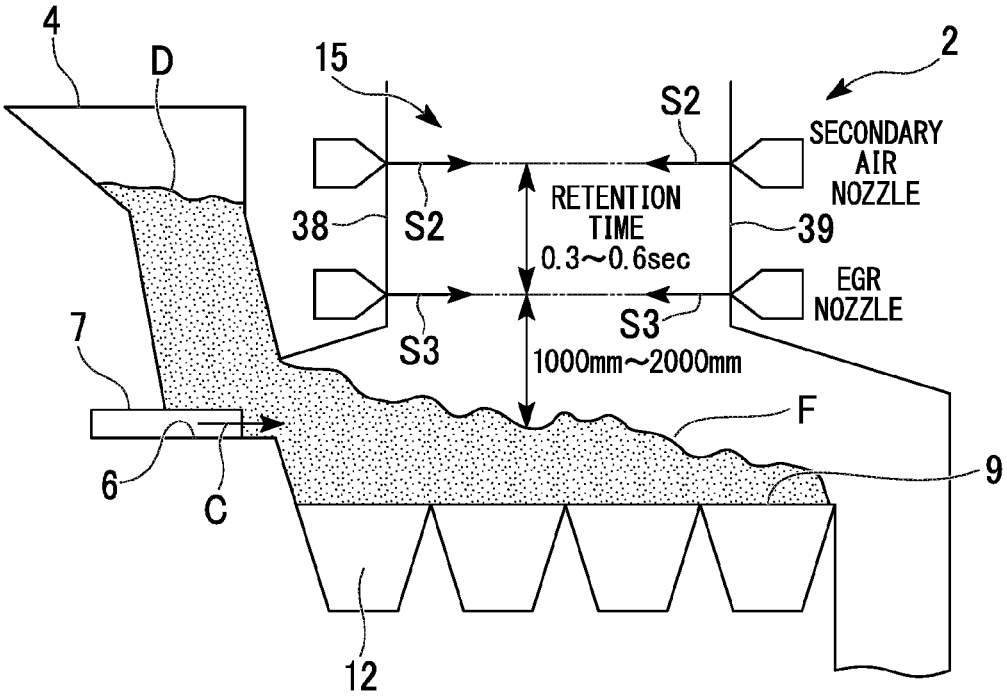
FIG. 2 is a configuration view schematically illustrating a stoker-type incinerator of the first embodiment of the present invention.
Figure 3A:
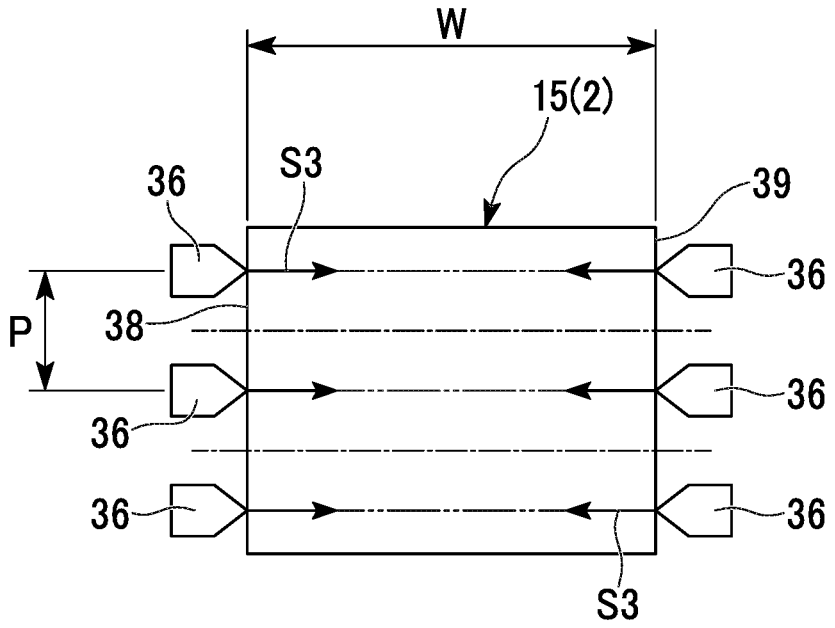
FIG. 3A is a plan view schematically describing arrangement of EGR nozzles in the stoker-type incinerator.
Figure 3B:
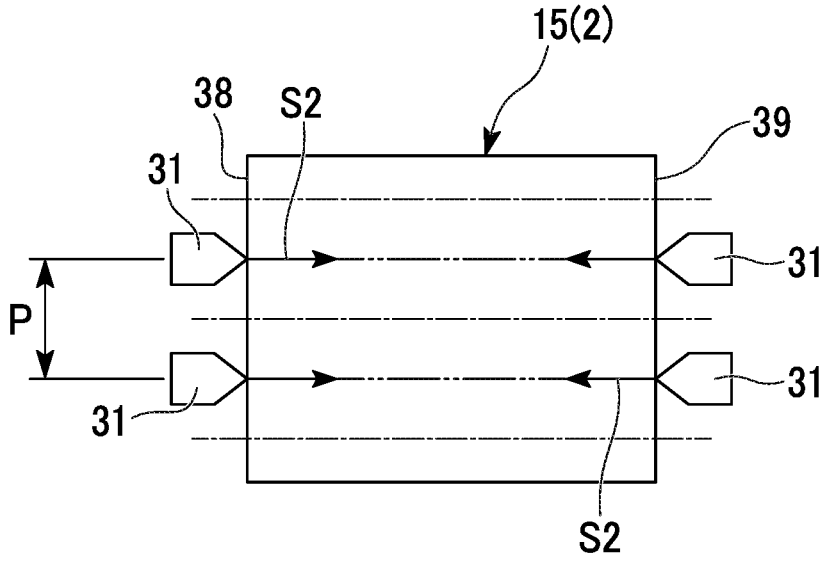
FIG. 3B is a plan view schematically describing arrangement of secondary combustion air nozzles in the stoker-type incinerator.

As illustrated in FIGS. 2, 3A, and 3B, secondary combustion air nozzles 31 and EGR nozzles 36 are provided on a front wall 38 and a rear wall 39 of the combustion gas channel 15 of the stoker-type incinerator 2. The secondary combustion air nozzles 31 and the EGR nozzles 36 are arranged so as to respectively face each other from a side of supplying the object to be incinerated and a side of ember combustion.

As illustrated in FIG. 2, the EGR nozzles 36 are directed to supply recirculated exhaust gas S3 along a conveyance direction C of the object D to be incinerated. Since the object D to be incinerated is extruded in the horizontal direction by the feeder 7, the EGR nozzles 36 are configured to face each other in a direction parallel to the stoker 9 and eject recirculated exhaust gas S3 parallel to the stoker 9. In this manner, the recirculated exhaust gas S3 ejected from the EGR nozzles 36 facing each other through the combustion gas channel 15 collide with each other in the combustion gas channel 15.

The EGR nozzles 36 are arranged at a height of 1000 mm to 2000 mm from a surface F of a fuel layer formed by the object D to be incinerated which is supplied to the stoker 9. In other words, the EGR nozzles 36 are arranged to be low to the extent that combustion inhibition on the surface F of the fuel layer is not caused by the recirculated exhaust gas S3 supplied from the EGR nozzles 36. The pressure of the recirculated exhaust gas S3 to be supplied is set to be in a range of 1 kPa to 5 kPa in the EGR nozzles 36.

Similarly, the secondary combustion air nozzles 31 are directed to supply secondary combustion air S2 along a conveyance direction C of the object D to be incinerated. The secondary combustion air nozzles 31 are configured to face each other in the horizontal direction and to eject the secondary combustion air S2 in the horizontal direction. In this manner, the secondary combustion air S2 ejected from the secondary combustion air nozzles 31 facing each other through the combustion gas channel 15 collide with each other in the combustion gas channel 15.

The position of the secondary combustion air nozzles 31 in the circulation direction of the combustion gas R is set in accordance with the retention time of the combustion gas R. The secondary combustion air nozzles 31 are arranged at the position on the downstream side of the EGR nozzles 36 at a retention time of 0.3 to 0.6 seconds. In other words, the position where the secondary combustion air nozzles 31 are arranged is set such that the retention time of the combustion gas R between the position where EGR nozzles 36 are arranged and the position where the secondary combustion air nozzles 31 are arranged is in a range of 0.3 to 0.6 seconds.

As illustrated in FIGS. 3A and 3B, the secondary combustion air nozzles 31 and the EGR nozzles 36 are arranged at different positions in a plan view (seen from the upper side). In other words, a plurality of the secondary combustion air nozzles 31 and the EGR nozzles 36 are alternately arranged (staggered arrangement) in a plan view.

The EGR nozzles 36 are arranged on the front wall 38 and the rear wall 39 in the width direction at equal intervals. In the stoker-type incinerator 2 of the present embodiment, three EGR nozzles 36 are arranged on the front wall 38 at equal intervals and three EGR nozzles 36 are arranged on the rear wall 39 at equal intervals. Three EGR nozzles 36 on the front wall 38 and three EGR nozzles 36 on the rear wall 39 are arranged to face each other.

The secondary combustion air nozzles 31 are arranged in the intermediate position of the EGR nozzles 36 adjacent to each other in a plan view. In the stoker-type incinerator 2 of the present embodiment, two secondary combustion air nozzles 31 are arranged on the front wall 38 at equal intervals and two secondary combustion air nozzles 31 are arranged on the rear wall 39 at equal intervals. Two secondary combustion air nozzles 31 on the front wall 38 and the secondary combustion air nozzles 31 on the rear wall 39 are arranged to face each other.

Figure 4:
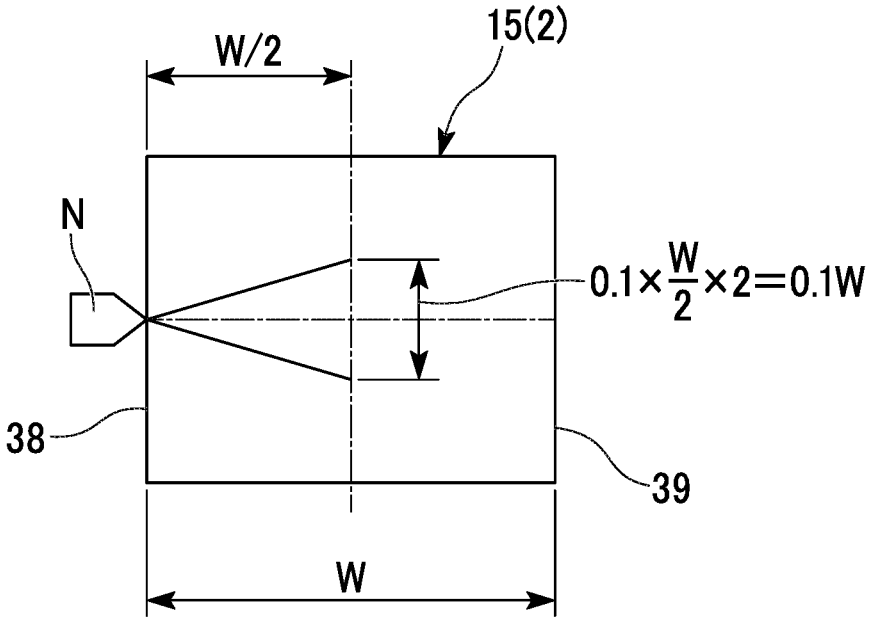
FIG. 4 is a plan view schematically describing the spread of gas injected from a nozzle provided on a furnace wall of the stoker-type incinerator.

An interval P (pitch) of the EGR nozzles 36 adjacent to each other is set to satisfy "$P<0.15\times W$" when the front-to-rear distance between the front wall 38 and the rear wall 39 of the stoker-type incinerator 2 is set to W. The interval is set in this manner as the result of consideration of the spread of gas ejected from nozzles. As illustrated in FIG. 4, for example, it is known that gas ejected from nozzles N provided on the front wall 38 of the stoker-type incinerator 2 spreads to have a width of 0.1 W in the intermediate position (W/2) of the front-to-rear distance W. The pitch P between nozzles of the present embodiment is set in consideration of this knowledge.

When the object D to be incinerated is subjected to an incineration treatment in the incineration facility 1 of the present embodiment, the object D to be incinerated which is fallen onto the stoker 9 in the stoker-type incinerator 2 due to the drive of the feeder 7 is sequentially conveyed to the drying stoker portion M1, the combustion stoker portion M2, and the post-combustion stoker portion M3 by reciprocation of fire grates. At this time, primary combustion air S1 is supplied to each of the stoker portions M1, M2, and M3 from the air box 12 on the lower side by setting the air ratio to 0.8 to 1.0 and the object D to be incinerated is burned by this primary combustion air S1. Further, the object D to be incinerated is burned while being sequentially conveyed and ashes are discharged from the ash discharge port 13 provided with the outlet of the post-combustion stoker portion M3.

Here, the flow velocity of the primary combustion air S1 which is supplied to the object D to be incinerated on fire grates of the reciprocating stoker 9 from the lower side and is used to burn the object D to be incinerated is not so fast. Further, in the combustion gas R generated by burning the object D to be incinerated using the primary combustion air S1, distribution occurs in the concentration or the temperature of the gas components in the primary combustion chamber 16. Therefore, it takes time for the primary combustion air S1 and the combustion gas R to be mixed with each other and it also takes time until the components are completely burned.

For this reason, the incineration facility 1 is configured to supply the secondary combustion air S2 in the middle of the combustion gas channel 15, at an air ratio of approximately 0.2 to 0.4, to the combustion gas R flowing on the upper side in the stoker-type incinerator 2 from the primary combustion chamber 16, such that combustion of unburned gas components of the combustion gas R is accelerated.

In addition, NOx is generated along with generation and combustion of unburned gas or unburned materials during the process of burning the object D to be incinerated in the above-described manner. A large amount of NOx is generated in the primary combustion chamber 16 particularly after the object D to be incinerated is incinerated by the primary combustion air S1.

Meanwhile, in the incineration facility 1 of the present embodiment, first, a part of the exhaust gas R', for example, the exhaust gas R' at a total amount of approximately 10% to 30% which is sent to the heat recovery boiler 18 from the stoker-type incinerator 2, thermally recovered by the heat recovery boiler 18, and sequentially treated by the temperature reduction tower 22 and the reaction dust collector 23 is allowed to reflux to the combustion gas channel 15 between primary combustion air nozzles and the secondary combustion air nozzles 31 as the recirculated exhaust gas S3.

Further, when the recirculated exhaust gas S3 is supplied in the above-described manner, the combustion gas R in the primary combustion chamber 16 is stirred and mixed by the recirculated exhaust gas S3. In this manner, the concentration or the temperature of the gas components in the primary combustion chamber 16 is uniformized and combustion of unburned gas or unburned materials in a reducing atmosphere is accelerated. Accordingly, generation of NOx is suppressed.

The static pressure of gas in the vicinity of the front and rear walls of the boiler close to the EGR nozzles 36 is decreased due to the recirculated exhaust gas S3 to be supplied. In this manner, so-called main combustion gas mainly generated in the vicinity of the central portion on the stoker 9 is drawn in the direction of EGR nozzles 36 and mixing of the main combustion gas with surplus oxygen caused by combustion air to be supplied to a waste drying region and an ember combustion region is accelerated.

As the result, stable flame obtained by effectively utilizing the cross-sectional area of the furnace can be formed in an area around the cross sections of the EGR nozzles 36 and heat sources required to dry and burn waste are stably supplied. In this manner, the primary combustion air S1 can be greatly reduced without increasing the unburned content in incinerated ashes.

Further, since the downward flow generated due to collision resulting from the injection of the secondary combustion air S2 by arranging the secondary combustion air nozzles 31 on the downstream of the EGR nozzles 36 is operated such that the combustion gas R is retained in the vicinity of the cross sections of the EGR nozzles 36, self denitration can be accelerated.

In addition, since the EGR nozzles 36 and the secondary combustion air nozzles 31 are alternately arranged, gas having passed via the EGR nozzles 36 can be mixed with the secondary combustion air S2 and burned. As the result, since combustion at a low air ratio, in which amounts of NOx and CO are both reduced can be realized, the total amount of exhaust gas extracted from the smoke stack can be greatly reduced, and the amount of steam used during the incineration process can be reduced, an increase in electric power generation can be realized.

Moreover, the same effects can be obtained in all scales through disposition of the EGR nozzles 36 and the secondary combustion air nozzles 31 on the front and rear wall of the boiler and through enlargement in the furnace width direction at the time of an increase in size.

Further, the method of arranging the EGR nozzles 36 and the secondary combustion air nozzles 31 is not limited to the above-described method as long as the EGR nozzles 36 and the secondary combustion air nozzles 31 are arranged in different positions in a plan view.

Figure 5A:
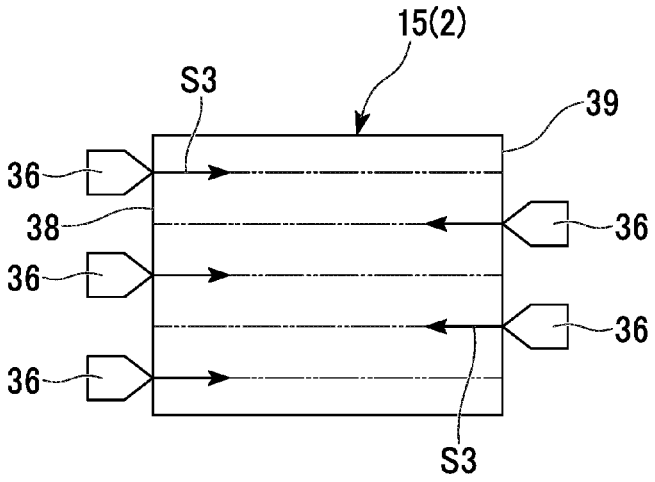
FIG. 5A is a plan view schematically describing another example of arrangement of EGR nozzles in a stoker-type incinerator.
Figure 5B:
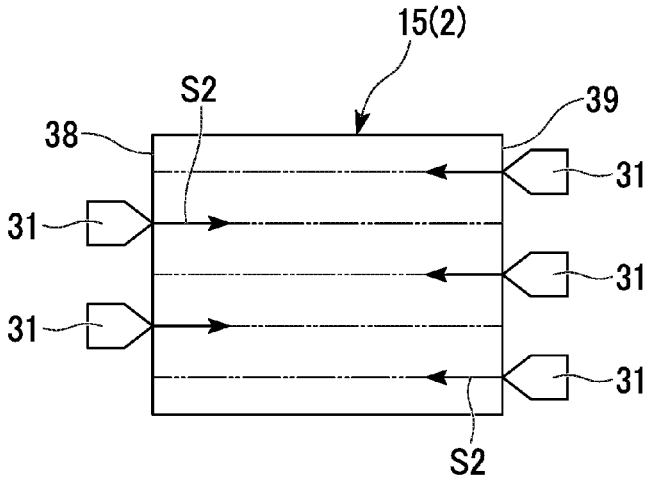
FIG. 5B is a plan view schematically describing another example of arrangement of secondary combustion air nozzles in a stoker-type incinerator.

For example, as in another example illustrated in FIGS. 5A and 5B, the EGR nozzles 36 arranged on the front wall 38 and the EGR nozzles 36 arranged on the rear wall 39 may be alternately arranged without arranging the nozzles to face each other and the secondary combustion air nozzles 31 arranged on the front wall 38 and the secondary combustion air nozzles 31 arranged on the rear wall 39 may be alternately arranged without arranging the nozzles to face each other.

Specifically, two secondary combustion air nozzles 31 on the front wall 38 are arranged in the intermediate position of the EGR nozzles 36 on the front wall 38 which are adjacent to each other in a plan view and two EGR nozzles 36 on the rear wall 39 are arranged in the intermediate direction of the secondary combustion air nozzles 31 on the rear wall 39 which are adjacent to each other in a plan view.

In a case where collision of gas resulting from arrangement of nozzles 31 and 36 to face each other exhibits undesirable effects, the nozzles can be arranged as in these modified examples.

Second Embodiment

Hereinafter, a stoker-type incinerator 2B of a second embodiment of the present invention will be described with reference to the accompanying drawings. In the present embodiment, differences from the first embodiment described above will be mainly described and the description on the same parts will not be repeated.

Figure 6:
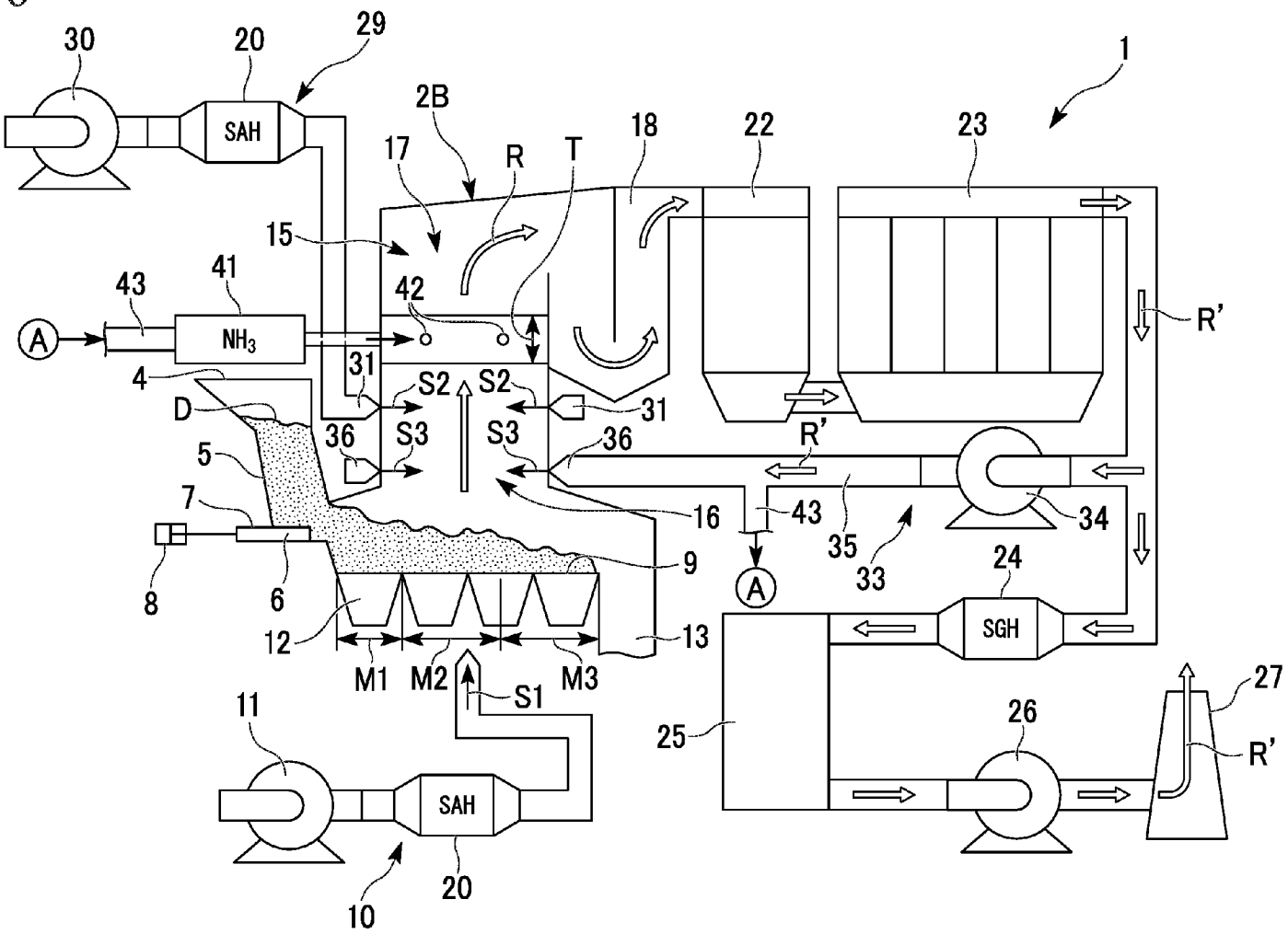
FIG. 6 a configuration view schematically illustrating an incineration facility of a second embodiment of the present invention.

As illustrated in FIG. 6, the stoker-type incinerator 2B of the present embodiment includes a reducing agent supply device 41 (reducing agent supply unit) which supplies a reducing agent (denitration chemical agent) such as $NH_3$ (ammonia). The reducing agent supply device 41 is connected to a reducing agent nozzle 42 provided on the downstream side of a secondary combustion air nozzle 31 and an EGR nozzle 36 in the circulation direction of combustion gas R. $NH_3$ gas or vaporized gas of $NH_3$ water is preferable as the reducing agent.

The reducing agent supply device 41 functions as a non-catalytic denitration system of supplying a reducing agent into a furnace of a stoker-type incinerator 2 and reducing NOx contained in the combustion gas R for reduction in amount of NOx and detoxication.

A branched passage 43 branched from a recirculation passage 35 is connected to the reducing agent supply device 41 and recirculated exhaust gas (exhaust gas R') can be used as gas for stirring a reducing agent which stirs a reducing agent. One or more reducing agent nozzles 42 are respectively disposed on both surfaces of left and right side walls 40 of the stoker-type incinerator 2B. That is, the reducing agent supply device 41 adds the reducing agent to a part of exhaust gas R' and blows the exhaust gas R' to the downstream of secondary combustion air nozzles 31.

The reducing agent nozzles 42 are disposed in a position where mixed gas G of the reducing agent and the exhaust gas can be blown to combustion gas R in a temperature range T of a furnace temperature of 950° C. to 1050° C. of the stoker-type incinerator 2B. The supply pressure of the mixed gas G of the reducing agent and the exhaust gas to the stoker-type incinerator 2B is set to be in a range of 3 kPa to 5 kPa.

Figure 7:
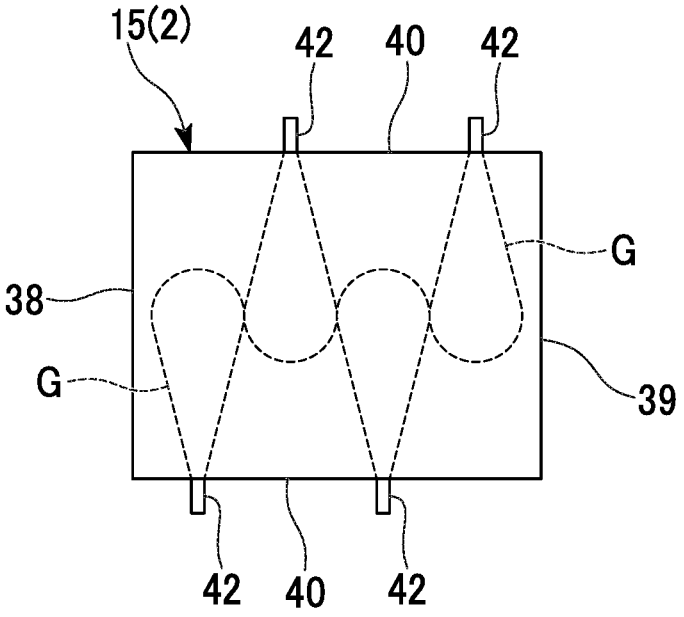
FIG. 7 is a plan view schematically describing arrangement of reducing agent nozzles in a stoker-type incinerator.

As illustrated in FIG. 7, the reducing agent nozzles 42 are provided on side walls 40 of a combustion gas channel 15 of the stoker-type incinerator 2B. The reducing agent nozzles 42 are arranged such that reducing agent nozzles 42 provided on one side wall 40 and reducing agent nozzles 42 provided on the other side wall 40 are alternately arranged (staggered arrangement). In other words, the reducing agent nozzles 42 provided on one side wall 40 and the reducing agent nozzles 42 provided on the other side wall 40 are not arranged to face each other.

By employing such arrangement, the mixed gas G is ejected into the furnace thoroughly.

Further, the collision of the mixed gas G ejected from the reducing agent nozzles 42 is suppressed. When collision of the mixed gas G containing a reducing agent occurs in the furnace, a region at a low temperature remains in some cases because of a reducing agent at a low temperature. It is possible to prevent a region at a low temperature from remaining by means of suppressing the collision of the mixed gas.

For example, in a case where the incinerator is large, the reducing agent nozzles 42 can be disposed on a front wall 38 as well as the side walls 40 of the stoker-type incinerator 2.

Further, exhaust gas is not necessarily branched from the recirculation passage 35 on the downstream side of a recirculated exhaust gas blower 34 and may be branched from anywhere on the downstream side of a reaction dust collector 23.

According to a non-catalytic denitration method of the embodiment described above, a reducing agent and recirculated exhaust gas serving as gas for stirring a reducing agent are supplied to the furnace of the stoker-type incinerator 2B from the same reducing agent nozzle 42 using recirculated exhaust gas S3 as gas for stirring a reducing agent. When the recirculated exhaust gas S3 is used as the gas for stirring a reducing agent, it is possible to prevent oxidation of the reducing agent compared to the air.

Further, distribution of the temperature and the concentration of gas in a non-catalytic denitration region is decreased due to strong effects of stirring recirculated exhaust gas S3. Therefore, non-catalytic denitration performance is improved and robustness against various variable factors is improved.

In addition, since the density of recirculated exhaust gas S3 is larger than the density of water steam, the stirring effects are improved when the supply power is the same, thereby obtaining higher denitration performance.

It is possible to prevent a reducing agent from becoming a new NOx generation source and to prevent the reducing agent from being discharged in a state of being unreacted by means of supplying the mixed gas G of the reducing agent and the exhaust gas to combustion gas R in a temperature range T of 950° C. to 1050° C. of the stoker-type incinerator 2.

Further, the technical scope of the present invention is not limited to the above-described embodiments and various modifications can be added in the range not departing from the gist of the present invention.

For example, in each of the embodiments described above, the configuration in which the primary combustion air S1 and the secondary combustion air S2 are supplied from separate systems is employed, but a configuration in which the secondary combustion air S2 is supplied from the primary combustion air supply unit 10 may be employed.

REFERENCE SIGNS LIST

1: incineration facility
2, 2B: stoker-type incinerator
4: hopper
5: chute portion
6: feeder table
7: feeder
8: feeder drive device
9: stoker
10: primary combustion air supply unit
11: pressure blower
12: air box
13: ash discharge port
15: combustion gas channel
16: primary combustion chamber
17: secondary combustion chamber
18: heat recovery boiler
20: steam air heater
22: temperature reduction tower
23: reaction dust collector
24: steam gas heater
25: catalytic reaction tower
26: induced blower
27: smoke stack
29: secondary combustion air supply unit
30: secondary pressure blower
31: secondary combustion air nozzle
33: recirculated exhaust gas supply unit
34: recirculated exhaust gas blower
35: recirculation passage
36: EGR nozzle (recirculated exhaust gas nozzle)
38: front wall
39: rear wall
40: side wall
41: reducing agent supply device (reducing agent supply unit)
42: reducing agent nozzle
43: branched passage
D: object to be incinerated
R: combustion gas
S1: primary combustion air
S2: secondary combustion air
S3: recirculated exhaust gas

The invention claimed is:

1. A stoker-type incinerator comprising:

a stoker configured to burn an object to be incinerated while being conveyed;

a combustion gas channel configured to guide combustion gas generated due to combustion of the object to be incinerated upward;

a primary combustion air supply unit configured to supply primary combustion air to the stoker;

a recirculated exhaust gas supply unit configured to cause exhaust gas resulting from treating the combustion gas that has circulated through the combustion gas channel to reflux to the combustion gas channel via a plurality of recirculated exhaust gas nozzles provided on the combustion gas channel, and supply the exhaust gas as recirculated exhaust gas; and a secondary combustion air supply unit configured to supply secondary combustion air into the combustion gas channel, on a downstream of the plurality of recirculated exhaust gas nozzles in a circulation direction of the exhaust gas via a plurality of secondary combustion air nozzles provided on the combustion gas channel, wherein the plurality of recirculated exhaust gas nozzles is arranged facing a conveyance direction of the object to be incinerated, the plurality of secondary combustion air nozzles is arranged facing the conveyance direction of the object to be incinerated, and the plurality of recirculated exhaust gas nozzles and the plurality of secondary combustion air nozzles are arranged in different positions in a plan view and alternately arranged in the plan view.

2. A stoker-type incinerator comprising:

a stoker configured to burn an object to be incinerated while being conveyed;

a combustion gas channel configured to guide combustion gas generated due to combustion of the object to be incinerated upward;

a primary combustion air supply unit configured to supply primary combustion air to the stoker;

a recirculated exhaust gas supply unit configured to cause exhaust gas resulting from treating the combustion gas that has circulated through the combustion gas channel to reflux to the combustion gas channel via a plurality of recirculated exhaust gas nozzles provided on the combustion gas channel, and supply the exhaust gas as recirculated exhaust gas; and a secondary combustion air supply unit configured to supply secondary combustion air into the combustion gas channel, on a downstream of the plurality of recirculated exhaust gas nozzles in a circulation direction of the exhaust gas via a plurality of secondary combustion air nozzles provided on the combustion gas channel, wherein the plurality of recirculated exhaust gas nozzles is arranged in the same position in the circulation direction of the exhaust gas and alternately arranged in the conveyance direction of the object to be incinerated so as to configure a staggered arrangement of the plurality of recirculated exhaust gas nozzles in a plan view, and the plurality of secondary combustion air nozzles is arranged in the same position in the circulation direction of the exhaust gas and alternately arranged in the conveyance direction of the object to be incinerated so as to configure a staggered arrangement of the plurality of secondary combustion air nozzles in the plan view.

3. The stoker-type incinerator according to claim 1, wherein the plurality of recirculated exhaust gas nozzles is configured to supply the recirculated exhaust gas along the conveyance direction of the object to be incinerated, and the plurality of secondary combustion air nozzles is configured to supply the secondary combustion air along the conveyance direction of the object to be incinerated.

4. The stoker-type incinerator according to claim 1, wherein the plurality of recirculated exhaust gas nozzles is arranged at a height of 1000 mm to 2000 mm from a surface of a fuel layer formed by the object to be incinerated which is supplied to the stoker.

5. The stoker-type incinerator according to claim 1, further comprising:

a reducing agent supply unit configured to add a reducing agent to a part of the recirculated exhaust gas and blow the part of the recirculated exhaust gas with the added reducing agent to the downstream of the plurality of secondary combustion air nozzles.

6. The stoker-type incinerator according to claim 5, wherein the reducing agent supply unit is configured to blow the reducing agent into the downstream of the plurality of secondary combustion air nozzles in a furnace temperature range of 950° C. to 1050° C.

7. The stoker-type incinerator according to claim 2, wherein the plurality of recirculated exhaust gas nozzles is configured to supply the recirculated exhaust gas along the conveyance direction of the object to be incinerated, and the plurality of secondary combustion air nozzles is configured to supply the secondary combustion air along the conveyance direction of the object to be incinerated.

8. The stoker-type incinerator according to claim 2, wherein the plurality of recirculated exhaust gas nozzles is arranged at a height of 1000 mm to 2000 mm from a surface of a fuel layer formed by the object to be incinerated which is supplied to the stoker.

9. The stoker-type incinerator according to claim 2, further comprising:

a reducing agent supply unit configured to add a reducing agent to a part of the recirculated exhaust gas and blow the part of the recirculated exhaust gas with the added reducing agent to the downstream of the plurality of secondary combustion air nozzles.

10. The stoker-type incinerator according to claim 9, wherein the reducing agent supply unit is configured to blow the reducing agent into the downstream of the plurality of secondary combustion air nozzles in a furnace temperature range of 950° C. to 1050° C.

11. The stoker-type incinerator according to claim 1, wherein the plurality of recirculated exhaust gas nozzles is arranged in the same position in the circulation direction of the exhaust gas and alternately arranged in the conveyance direction of the object to be incinerated so as to configure a staggered arrangement of the plurality of recirculated exhaust gas nozzles in the plan view, and the plurality of secondary combustion air nozzles is arranged in the same position in the circulation direction of the exhaust gas and alternately arranged in the conveyance direction of the object to be incinerated so as to configure a staggered arrangement of the plurality of secondary combustion air nozzles in the plan view.

12. The stoker-type incinerator according to claim 1, wherein the plan view is a view of the combustion gas channel along a direction perpendicular to the conveyance direction of the object to be incinerated.

13. The stoker-type incinerator according to claim 2, wherein the plan view is a view of the combustion gas channel along a direction perpendicular to the conveyance direction of the object to be incinerated.

* * * * *